204-290
10/15/85 OR 4,547,278

United States Patent [19]
Hall et al.

[11] Patent Number: 4,547,278
[45] Date of Patent: Oct. 15, 1985

[54] CATHODE FOR HYDROGEN EVOLUTION

[75] Inventors: Dale E. Hall, Monroe; Douglas S. Brown, Tuxedo, both of N.Y.

[73] Assignee: Inco Alloys International, Inc., Huntington, W. Va.

[21] Appl. No.: 639,811

[22] Filed: Aug. 10, 1984

[51] Int. Cl.[4] ..... C25B 11/00
[52] U.S. Cl. ..... 204/290 R; 204/129
[58] Field of Search ..... 204/290 R

[56] References Cited

U.S. PATENT DOCUMENTS 4,279,713 7/1981 Tseung ..... 204/290 R
4,385,019 5/1983 Bernstein ..... 204/293
4,421,579 12/1983 Covitch ..... 204/290 R

FOREIGN PATENT DOCUMENTS 89141A 9/1983 European Pat. Off. .

OTHER PUBLICATIONS

Tseung et al., Electrochemica Acta, 1976, vol. 21, pp. 315–318.

*Primary Examiner*—John F. Niebling
*Attorney, Agent, or Firm*—Francis J. Mulligan, Jr.; Raymond J. Kenny

[57] ABSTRACT

A cathode for hydrogen evolution comprising a substrate stable in aqueous alkaline media having on the surface thereof a coating of particles of an $AB_N$ intermetallic, and optionally particles of a metal inert in the electrolyte, e.g., nickel, adhered to the substrate by sintered polytetrafluoroethylene or similar polymer.

11 Claims, No Drawings

CATHODE FOR HYDROGEN EVOLUTION

The present invention is directed to a hydrogen evolution cathode useful in aqueous electrolysis.

PRIOR ART AND BACKGROUND OF INVENTION

There is disclosed in European patent specification No. 89141A of Sept. 21, 1983 a cathode having a nickel or nickel-coated iron substrate and a catalytically active coating containing a powder mixture of an intermetallic $AB_5$ compound and nickel. The coating was applied from an aqueous polysilicate slurry and sintered in hydrogen to create a metallurgical bond to the substrate. This cathode exhibits excellent electrocatalytic activity. However, the following drawbacks were encountered during manufacture of cathodes of industrial size. First manufacturing costs were high, primarily because of the high temperature, hydrogen atmosphere sintering step. Secondly, the cathode substrate was extremely soft after heat treatment. Finally, the high sintering temperatures and times required to produce a coating with good abrasion resistance had an adverse effect on catalytic activity.

Also in European patent specification No. 89141A, there is disclosed hydrogen evolution cathodes containing polytetrafluoroethylene (PTFE). These PTFE-containing cathodes were fibrillated to produce the PTFE binder matrix. They were highly efficient, but had the following drawbacks:

1. Fibrillation produced some mechanical working and physical damage to the $AB_5$ catalyst.
2. The fabrication process was not amendable to producing a thin, catalytically active coating on cathode substrates preferred by industry.
3. The polymer content was too low to give sufficient strength, i.e., catalyst was lost in visible quantities during short electrolysis trials.

In addition to the aforementioned patent specification there is to be noted the publication "A study of Gas Evolution in Teflon Bonded Porous Electrodes III, Performance of Teflon Bonded Pt Back Electrodes for $H_2$ Evolution; ACC Tseung et al Electrochemica Acta, 1976 Vol. 21 pp. 315–318. The Tseung et al article deals with cathodes containing at least a troy ounce of platinum per square meter, i.e., cathodes having a material cost of about $400 (U.S.) per square meter of cathode. For practical industrial purposes, such cathodes are too expensive.

OBJECT OF THE INVENTION

It is the object of the invention to provide a new, useful hydrogen evolution cathode employing an $AB_5$ intermetallic compound or a hydride or a hydrogen-containing species of said $AB_5$ intermetallic compound as an electro-catalyst and method for making such a cathode.

DESCRIPTION OF THE INVENTION

The present invention contemplates a cathode having an electrically conductive substrate not readily attacked by aqueous alkaline solutions which may contain substantial amounts of chloride ion and having on at least a part of the surface of said substrate a mixture of powdered $AB_N$ compound (or, when operating or prior to operation, a hydride of said compound or a hydrogen-containing variant of said compound) and, optionally metal powder inert in aqueous alkali, and sintered, non-fibrillated polytetrafluoroethylene (PTFE) or similar polymer, said mixture comprising about 5% to 30% by weight of said polymer based upon total weight of said polymer, said $AB_N$ compound and said metal powder. Polymers similar to PTFE include polyvinylidene fluoride, polychlorotrifluoroethylene, fluorinated ethylene propylene polynmer, polyperfluoroalkoxyethylene and silicones. Metal powder inert in aqueous alkali is advantageously pure nickel powder but nickel-iron alloy powder can also be used. The cathode is further characterized by the fact that, when present, the amount of nickel in weight percent does not exceed the amount of $AB_N$ compound in weight percent.

The $AB_N$ compound used in the cathode of the present invention contains

- as A one or more members of the group consisting of rare earth elements and calcium which can be replaced in part, e.g., up to about 0.2 atom by zirconium or thorium or both.
- as B nickel and/or cobalt which may be replaced in amounts up to about 1.5 atom by aluminum, copper, tin, iron and/or chromium, and is characterized in that the subscript N has a value generally between 4 and 8. Advantageously the value of subscript N is about 5. However, when as is advantageous, intermetallic compounds involving rare earths and nickel are used, the $AB_5$ compound may be associated with other materials such as $A_2Ni_{17}$ or nickel. Such compounds in such association are useful and included within the scope of the present invention. Advanageously relatively pure materials such as $MMNi_5$ (MM=mischmetal), $LaNi_5$ and $LaNi_{4.7}Al_{0.3}$ are the electrocatalytic material used in the cathodes of the present invention.

We also prefer to use as the $AB_5$ phase compounds of lanthanum or other rare earth metal with nickel in which up to 1.5 of the 5 atoms is replaced by aluminum or copper, or a compound essentially of the composition $CaNi_5$.

Rare earths used in the $AB_5$ compound in preparing cathodes of the present invention are conveniently in the form of relatively inexpensive mixtures such as mischmetal (MM) or cerium-free mischmetal (CFM). Compositions in weight percent, of commonly available grades of these mixtures are set forth in Table I.

TABLE I

| Element | MM | CFM |
|---|---|---|
| Ce | 48–50 | about 0.8 |
| La | 32–34 | about 61.6 |
| Pr | 4–5 | about 9.2 |
| Nd | 13–14 | about 28.5 |

Nickel powder which may optionally be present in the cathode of the invention is preferably a powder produced by the thermal decomposition of nickel carbonyl. Various grades of such nickel powders are commercially available and exhibit a variety of particle size and shape characteristics. Nickel powder sold by INCO Limited under the grade designation "123" is especially satisfactory for use in the cathodes of the present invention. Other grades of nickel powder sold by INCO Limited which can be used include 287 and 255.

PTFE in the cathodes of the present invention is employed in sintered form. Preferably, in making the cathodes of the present invention, the electrocatalyst and, optionally nickel, as fine particles are dispersed in an aqueous vehicle to which PTFE particles are added. A typical formulation to produce about 11 liters of slurry employs a vehicle as set forth in Table II.

TABLE II

| | |
|---|---|
| Water | 7905 ml |
| Kelzan TM xanthan gum | 73 grams |
| POLYOX TM grade P48 silica sol | 1178 ml |

A mixture of −325 mesh $AB_5$ powder (50–100% of metal solids) and nickel powder (0–50% of metal solids is added to the vehicle. For the quantity of vehicle above, about 20 kg of metal powder would normally be used. Finally, very fine particulate PTFE is added to the slurry, either as a powder or in aqueous dispersion. For example, a 60% solids dispersion of DuPont Teflon TM 30 has been used. The amount of PTFE is about 5–30% of the total slurry solids (metal+PTFE).

The substances to be coated with slurry can be nickel, nickel/iron alloy, steel, steel coated with nickel or other commonly used cathode materials. Preferred substrate forms are woven screen, expanded metal, porous formed or other foraminous forms, as well as metal sheet. The coating is applied by any conventional paint coating technique. For example, spray coating works particularly well. The desired coating load is about 100–500 g/m$^2$ and more advantageously 200 to 375 g/m$^2$ (dry weight). The coating is dried and sintered under inert gas at abnout 340° to about 382° C. We have sintered for 30 minutes, but believe shorter times could be used. We believe that reducing atmospheres would also work. Sintering in air would be acceptable if the oxidation of the $AB_5$ catalyst was kept to a minimum. (Such oxidation produces an initial period of low catalytic activity during electrolysis.) Those skilled in the art will appreciate that Xanthan gum will be thermally degraded during sintering of PTFE and that any residue of the silica sol will rapidly be leached from cathodes by aqueous alkaline electrolyte. Accordingly, in use the cathodes of the present invention comprise the substrate, $AB_NH_X$ (where X is about 0 to 6) compound, nickel (if any) and PTFE.

EXAMPLES OF THE BEST MODE OF CARRYING OUT THE INVENTION

EXAMPLE 1

Five slurries were prepared with DuPont Teflon TM 30 suspension, and used to prepare coatings.

The vehicle employed was essentially that vehicle set forth in Table II. $LaNi_{4.7}Al_{0.3}$, PTFE and optionally nickel powder were added to the vehicle to give slurries having relative weights of PTFE, $AB_N$ and Ni as set forth in Table III.

TABLE III

| Slurry | PTFE | ABN | Ni |
|---|---|---|---|
| 1 | 20 | 40 | 40 |
| 2 | 29 | 35.5 | 35.5 |
| 3 | 14 | 43 | 43 |
| 4 | 14 | 43 | 43 |
| 5 | 20 | 80 | — |

Cathodes were made from the slurries having non-thermally decomposable and non-alkali-soluble solids as set forth in Table III by dip coating 25 mm by 75 mm pieces of Ni-ply screen. After dipping the coated screen was allowed to partially dry and then excess material was blown off using an air hose. After dip-coating usually three times, the coated screen was dried and then the coating PTFE was sintered under argon for 30 minutes at 360° C. and then kept in the argon atmosphere until cool. Coating loads as sintered are set forth in Table IV, the numerical designation of the cathode identifying the slurry used to coat the cathode.

TABLE IV

| Cathode No. | Area, cm$^2$ | Coating, g | Load g/m$^2$ |
|---|---|---|---|
| 1 | 6.96 | .2879 | 414 |
| 1A | 9.45 | .3502 | 371 |
| 2 | 9.45 | .2678 | 283 |
| 2A | 8.64 | .3524 | 408 |
| 3 | 8.61 | .3774 | 438 |
| 3A | 10.08 | .3953 | 392 |
| 4 | 10.56 | .6227 | 590 |
| 4A | 8.16 | .3602 | 441 |
| 5 | 7.44 | .1971 | 265 |
| 5A | 6.96 | .3180 | 457 |

Some cathodes enumerated in Table IV were tested in one-liter polypropylene cells containing 30% KOH aqueous electrolyte at 80° C. Woven nickel wire anodes were used. Electrolysis was carried out at 200 mA/cm$^2$ for 146 hours, except #4, which ran for 118 hours. Raw cathode potentials were measured vs. the Hg/HgO reference electrode. A computer program was used to correct for ohmic resistance losses so that iR-free overpotentials ($\eta H_2$) could be determined. Data obtained in these tests is set forth in Table V.

TABLE V

| Cathode | % PTFE | % Metal as $AB_5$ | $H_2$ V (iR-free)* | Weight Loss |
|---|---|---|---|---|
| 1 | 20 | 50 | 0.11 | 5.1 mg |
| 2A | 29 | 50 | 0.20 | 0.3 mg |
| 3 | 14 | 50 | 0.08 | 3.2 mg |
| 4A | 14 | 50 | 0.08 | 3.9 mg |
| 5A | 20 | 100 | 0.08 | 2.0 mg |

*Average steady-state readings.

Steady cathode potentials were reached within about 5 hours of electrolysis. The results indicate that, for cathodes containing equal $AB_5$/Ni ratios (nos. 1 and 4), increasing the PTFE content of the coating produced some decrease in cathode efficiency. For cathodes containing equal percentages of PTFE (nos. 1 and 5), overpotentials are lower for higher $AB_5$ catalyst percentages.

The cathodes were weighed before and after electrolysis to establish weight losses during test. During 146 hours of electrolysis, the results show that weight loss was restricted to ≦2% of total coating weight. This is comparable to or better than sinter-metal-bonded cathodes as disclosed in European application No. 89141A, which have performed satisfactorily for more than 6000 hours of electrolysis. Further, the data indicate that for cathodes 1–4, in which the metal powder morphology was identical, increasing the PTFE content from 14 to 20 to 29% produces a reduction in weight loss. At equal PTFE contents (cathodes 1 and 5), introduction of Ni 123 powder, which has a spiky, high surface morphology, reduces weight loss.

EXAMPLE 2

Upon conclusion of the 146-hour electrolyses in Example 1, cathodes 1, 2A, 3 and 5A were installed in one-liter polypropylene test cells containing polypropylene fixtures which maintained constant and reproducible cell geometry, to avoid differences in ohmic drop from cell to cell. Anodes were made from woven nickel wire screen, and the electrolyte temperature and cathode current density were identical to those in Example 1. For comparison, an unactivated nickel-plated steel screen was also tested in the same manner. Cell voltages ($V_{cell}$) were recorded at periodic intervals during about 800 hours of electrolysis. Results are set forth in Table VI.

TABLE VI

| Time, hrs | $V_{cell}$ for cathode No.: (volts) | | | | |
|---|---|---|---|---|---|
| | Unactivated | 1 | 2A | 3 | 5A |
| 0 | 2.28 | 1.98 | 2.08 | 1.94 | 1.93 |
| 29 | 2.63 | 1.94 | 2.03 | 1.92 | 1.91 |
| 101 | 2.25 | 1.93 | 2.00 | 1.90 | 1.86 |
| 195 | 2.41 | 1.95 | 2.00 | 1.89 | 1.87 |
| 295 | 2.42 | 1.93 | 2.00 | 1.90 | 1.88 |
| 463 | 2.46 | 1.96 | 2.02 | 1.92 | 1.90 |
| 601 | 2.44 | 1.93 | 2.00 | 1.90 | 1.88 |
| 721 | 2.59 | 1.97 | * | 1.95 | 1.87 |
| 799 | 2.65 | 1.99 | * | 1.95 | 1.89 |
| 1069 | 2.64 | 2.00 | * | 1.95 | 1.88 |

*Discontinued

All of the $AB_N$-catalyzed cathodes were, as Table VI shows, significantly more efficient than the unactivated cathode. In addition, the voltage savings increased with time due to the flat voltage vs. time characteristics of the cells with $AB_N$-catalyzed cathodes. The data substantiate conclusions in Example 1 regarding the effects of PTFE and $AB_5$ content of the coating.

Cathode 2A was pulled from service after 655 hours of electrolysis. Coating weight loss was 2.07 mg (about 3.5 g/m$^2$, based on the 6 cm$^2$ cathode area), less than 1% of the original coating weight.

EXAMPLE 3

$AB_N$-catalyzed cathodes were made by spray coating a slurry with the following non-thermally decomposable, non-alkali soluble solids content: 15% PTFE, 42.5% $LaNi_{4.7}Al_{0.3}$ (−325 mesh) and 42.5% Ni 123 powder. The coatings were applied to woven nickel-plated steel screens, expanded nickel sheet, a heavy nickel sponge, and steel sheet. Coatings were sintered for 30 minutes at 360° C.

Using a Binks Model 7 spray gun with air pressure to the gun of about 4.4 atmospheres absolute, it was found that maximum coating strength was obtained when the coating was applied wet, rather than in a moist-dry spray. One cathode coated wet on expanded nickel to a coating load of 344 g/m$^2$, had high green and sintered strength. This cathode was operated for more than 260 hours under the conditions of Example 2 with the results as set forth in Table VII.

TABLE VII

| Time, hrs | $V_{cell}$, Volts |
|---|---|
| 0 | 2.01 |
| 4 | 1.90 |
| 22 | 1.87 |
| 94 | 1.83 |
| 118 | 1.85 |
| 142 | 1.85 |
| 172 | 1.86 |
| 262 | 1.86 |
| 508 | 1.87 |

EXAMPLE 4

Four coatings containing Teflon TM 30 polytetrafluoroethylene, Ni 123 powder and −325 mesh $LaNi_{4.7}Al_{0.3}$ powder were sprayed onto 152 mm×152 mm expanded nickel mesh substrates. The coatings, sintered using the same conditions described in the previous examples, are described in Table VIII.

TABLE VIII

| Cathode No. | Spray Type | % PTFE | Coating Load, g/m$^2$ | Sintered Strength* |
|---|---|---|---|---|
| 6 | wet | 15 | 388 | excellent |
| 7 | moist | 15 | 388 | good-fair |
| 8 | wet | 22 | 194 | very good |
| 9 | moist | 22 | 194 | good-fair |

*Abrasion test: all superior or equal to metallic bonded and sintered $AB_N$ cathodes coatings (sintered cathodes contained approximately 50% $AB_5$ + 50% Ni 123). For cathodes 6 to 9 the metal solids were 50% Ni 123 powder, and 50% $LaNi_4$-$Al_0$ powder (−325 mesh).

Cathodes were tested for more than 260 hours of electrolysis under conditions specified in Example 2. For comparison, an unactivated nickel screen cathode was also tested. Results are set forth in Table IX.

TABLE IX

| Time, hrs | $V_{cell}$, volts for cathode | | | | |
|---|---|---|---|---|---|
| | Unactivated | 6 | 7 | 8 | 9 |
| 0 | 2.18 | 2.00 | 2.01 | 2.05 | 2.11 |
| 4 | 2.13 | 1.90 | 1.93 | 1.99 | 2.05 |
| 22 | 2.20 | 1.88 | 1.90 | 1.97 | 2.03 |
| 94 | 2.36 | 1.85 | 1.88 | 1.93 | 1.97 |
| 118 | 2.27 | 1.87 | 1.89 | 1.95 | 1.99 |
| 142 | 2.44 | 1.87 | 1.89 | 1.94 | 1.97 |
| 172 | 2.26 | 1.87 | 1.89 | 1.96 | 1.97 |
| 262 | 2.37 | 1.88 | 1.90 | 1.97 | 2.00 |
| 508 | 2.26 | 1.88 | 1.91 | 2.04 | 2.08 |

The catalyzed cathodes were clearly superior to the unactivated (bare) nickel cathode. In addition, the results show that the 388 g/m$^2$ coatings, while more expensive, are also more efficient than the 194 g/m$^2$ coatings.

The embodiments of the invention in which an exclusive property or privilege are defined as follows:

1. A cathode for electrogeneration of hydrogen from an aqueous alkaline electrolyte comprising an electroconductive substrate substantially inert in said electrolyte having on at least part of the surface thereof an adherent coating of metal particles bonded to said substrate by a sintered unfibrillated polymer selected from the group of polytetrafluoroethylene polyvinylidene fluoride, poly chlorotrifluoroethylene, fluorinated ethylene propylene polymer polyperfluoro-alkoxyethylene and silicones, said metal powder particles being particles of $AB_N$ wherein A is one or more members of the group consisting of rare earth elements and calcium which can be replaced in part by zirconium or thorium or both, B is one or more members of the group consisting of nickel and cobalt which may be replaced up to 1.5 atom by one or more members of the group of aluminum, copper, tin, iron and chromium and N is a mumber between 4 and 8 with up to an equal weight of particles of a metal inert in said aqueous alkaline electrolyte.

2. A cathode as in claim 1 wherein the sintered, unfibrillated polytetrafluoroethylene comprises about 5% to about 30% by weight total metal particles plus polytetrafluoroethylene.

3. A cathode as in claim 1 wherein the particles of a metal inert in said aqueous alkaline electrolyte are nickel particles.

4. A cathode as in claim 2 wherein the $AB_N$ particles are particles of an $AB_5$ intermetallic in which A is selected from the group of rare earths and calcium B is selected from the group of nickel and cobalt and in which up to 0.2 atom of A can be replaced by zirconium or thorium or both and in which up to 1.5 atoms of B can be replaced by one or more of aluminum, copper, tin, iron and chromium.

5. A cathode as in claim 4 wherein the $AB_5$ particles are particles of $MMNi_5$.

6. A cathode as in claim 4 wherein the $AB_5$ particles are particles of $CFMNi_5$.

7. A cathode as in claim 4 wherein the $AB_5$ particles are particles of $LaNi_{4.7}Al_{0.3}$.

8. A cathode as in claim 4 wherein nickel metal particles are co-present with $AB_5$ particles.

9. A cathode as in claim 8 wherein the $AB_5$ particles are particles of $MMNi_5$.

10. A cathode as in claim 8 wherein the $AB_5$ particles are particles of $CFMNi_5$.

11. A cathode as in claim 8 wherein the $AB_5$ particles are particles of $LaNi_{4.7}Al_{0.3}$.

* * * * *